US012796793B2

(12) United States Patent
Burns

(10) Patent No.: US 12,796,793 B2
(45) Date of Patent: Nov. 17, 2026

(54) LUGGAGE IDENTIFYING SLEEVE

(71) Applicant: Lucia Burns, Paradise Valley, AZ (US)

(72) Inventor: Lucia Burns, Paradise Valley, AZ (US)

( * ) Notice: Subject to any disclaimer, the term of this patent is extended or adjusted under 35 U.S.C. 154(b) by 140 days.

(21) Appl. No.: 18/117,096

(22) Filed: Mar. 3, 2023

(65) Prior Publication Data

US 2024/0292933 A1 Sep. 5, 2024

(51) Int. Cl.
*A45C 13/42* (2006.01)

(52) U.S. Cl.
CPC ..... *A45C 13/42* (2013.01)

(58) Field of Classification Search
CPC ..... A45C 13/42; A45C 13/18; A45C 13/20
USPC ..... 190/26, 101–102; D19/34; 150/105, 154
See application file for complete search history.

(56) References Cited

U.S. PATENT DOCUMENTS

| | | | | | |
|---|---|---|---|---|---|
| 3,819,177 | A * | 6/1974 | Spiro | A63B 21/00043 | 482/122 |
| 5,054,816 | A * | 10/1991 | Rosengarten | B42D 9/004 | 206/472 |
| 5,082,156 | A * | 1/1992 | Braun | B25H 3/00 | 224/220 |
| 5,855,306 | A * | 1/1999 | Masak | A43B 5/0425 | 224/604 |
| D407,134 | S * | 3/1999 | Lively | D22/100 | |
| 6,749,095 | B2 * | 6/2004 | Johnson | A45C 13/26 | 224/257 |
| 7,041,032 | B1 * | 5/2006 | Calvano | A63B 26/00 | 482/148 |
| 7,326,134 | B2 * | 2/2008 | Collucci | A63B 21/4019 | 473/553 |
| D667,635 | S * | 9/2012 | Sanchez | D3/318 | |
| 9,301,865 | B2 * | 4/2016 | Farco | A44C 15/00 | |
| D755,521 | S * | 5/2016 | Wei | D3/318 | |
| D765,979 | S * | 9/2016 | Ascolese | D3/318 | |
| 10,085,535 | B2 * | 10/2018 | Lokkinen | F16B 2/08 | |
| 11,130,438 | B2 * | 9/2021 | Miller | B60P 7/0823 | |
| D1,033,590 | S * | 7/2024 | Watson | D23/206 | |
| 2006/0144661 | A1 * | 7/2006 | Burns | A45C 13/30 | 190/101 |
| 2007/0033709 | A1 * | 2/2007 | Forselius | A41F 9/00 | 2/237 |
| 2007/0095870 | A1 * | 5/2007 | Griffith | A45C 13/30 | 24/3.2 |

(Continued)

FOREIGN PATENT DOCUMENTS

| | | | |
|---|---|---|---|
| CN | 203424471 U | | 2/2014 |
| CN | 203913772 U | * | 11/2014 |

(Continued)

*Primary Examiner* — Cassandra Davis
(74) *Attorney, Agent, or Firm* — Lori Woodward

(57) ABSTRACT

A compressible sleeve and a kit comprising a plurality of compressible sleeves is disclosed herein. The compressible sleeve includes a band and a fastener element. The band is formed as a continuous loop and constructed from an elasticated material, enabling the band to compressively fit around a piece of luggage. The compressible sleeve enables a user to readily identify their luggage from a long distance, and also unifies two or more mismatched pieces of luggage. In addition, tension applied to the luggage via the band enables zipper pull tabs of the luggage to be placed underneath the band and prevented from moving, thus minimizing potential for luggage to be accidentally opened during transit.

1 Claim, 6 Drawing Sheets

(56) References Cited

U.S. PATENT DOCUMENTS

| | | | | |
|---|---|---|---|---|
| 2008/0088125 | A1* | 4/2008 | Montross | G09F 3/08 283/80 |
| 2008/0116028 | A1* | 5/2008 | Gold | A45C 13/30 190/102 |
| 2009/0194210 | A1 | 8/2009 | Montross | |
| 2010/0072794 | A1* | 3/2010 | Karovic | A47C 7/62 297/188.2 |
| 2010/0270116 | A1* | 10/2010 | Wilson | A45C 13/30 190/102 |
| 2013/0221047 | A1* | 8/2013 | Johnson | A45F 5/021 224/463 |
| 2014/0202813 | A1 | 7/2014 | Roccaforte | |
| 2022/0280825 | A1* | 9/2022 | Tumminello | A63B 21/0555 |

FOREIGN PATENT DOCUMENTS

| | | | | |
|---|---|---|---|---|
| CN | 208318562 | U | | 1/2019 |
| CN | 209300365 | U | * | 8/2019 |
| WO | 2017061897 | | | 4/2017 |

* cited by examiner

LUGGAGE IDENTIFYING SLEEVE

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of luggage of existing art and more specifically relates to luggage accessories.

RELATED ART

Luggage is used for the purpose of transporting personal belongings, such as clothing, toiletries, and other items, when traveling. Baggage claim, also known as baggage reclaim or baggage carousel, is the area at an airport where passengers collect their luggage after it has been unloaded from an aircraft. Due to the amount of luggage circulating in baggage claim, it is important for travelers to be able to easily identify their luggage. Otherwise, problems occur; such as travelers spending extra time searching for their luggage, difficulty for the airlines in locating misplaced or lost luggage, and an increased risk of theft of the luggage if not clearly labeled as belonging to a specific person.

Further, in many circumstances, such as for security checks, customs inspections, convenience, etc., travelers choose to leave their luggage unlocked. However, this can cause the luggage to inadvertently open, which often results in the loss of valuable or irreplaceable items. As such, a suitable solution is desired.

SUMMARY OF THE INVENTION

In view of the foregoing disadvantages inherent in the known luggage accessory art, the present disclosure provides a novel luggage identifying sleeve. The general purpose of the present disclosure, which will be described subsequently in greater detail, is to provide a sleeve device that is configured to be positioned around a piece of luggage and allows a user to readily identify the piece of luggage during travel.

A compressible sleeve is disclosed herein. The compressible sleeve is used for readily identifying a piece of luggage and may include a band and a fastener element. The band may be formed as a continuous loop and may include an inner surface opposite an outer surface. Further, the band may be constructed from an elasticated material such that the band is compressively fittable around the piece of luggage. The fastener element may be attached to the inner surface of the band and configured to fasten to a handle of the piece of luggage. The band and the fastener element may act in combination to provide improved identification of the piece of luggage and redundant securement of the piece of luggage when in use during travel.

According to another embodiment, a kit for use in unifying a plurality of mismatched pieces of luggage is also disclosed herein. The kit may include a plurality of compressible sleeves. Each of the compressible sleeves may include the band and the fastener element, as above. At least the outer surface of the each of the plurality of compressible sleeves may share the same functional decoration. As such, mismatched pieces of luggage are readily identifiable as a set.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a luggage identifying sleeve, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to luggage accessories and more particularly to a luggage identifying sleeve. Generally, in some embodiments the luggage identifying sleeve may include an easily applied closed loop, stretch fit band. Particularly, the band may be constructed of a dual ply colored, patterned, branded, etc. spandex fabric and may include a small loop of fabric sewn into an interior seam to attach the band to a luggage handle. The band may include a width of 5 inches, and may be available in two sizes of lengths-ranging between 12-16 inches. The band is easily attached to luggage without the use of buckles, clips or other breakable portions and may be provided in unlimited designs and colors.

The luggage identifying sleeve enables a user to readily identify their luggage from a long distance, and also unifies two or more mismatched pieces of luggage. In addition, tension applied to the luggage via the band may enable zipper pull tabs of the luggage to be placed underneath the band and prevented from moving, thus minimizing potential for luggage to be accidentally opened during transit.

Referring now more specifically to the drawings by numerals of reference, there is shown in FIGS. 1-6, various views of a compressible sleeve 100. As shown in these figures, the compressible sleeve 100 may include a band 110 and a fastener element 120. The compressible sleeve 100 may preferably be used for readily identifying a piece of luggage 5, and as such, the compressible sleeve 100 may include at least one luggage identifier. Particularly, the band 110 and the fastener element 120 may act in combination to provide improved identification of the piece of luggage 5 and redundant securement of the piece of luggage 5 when in use during travel.

Figure 1:
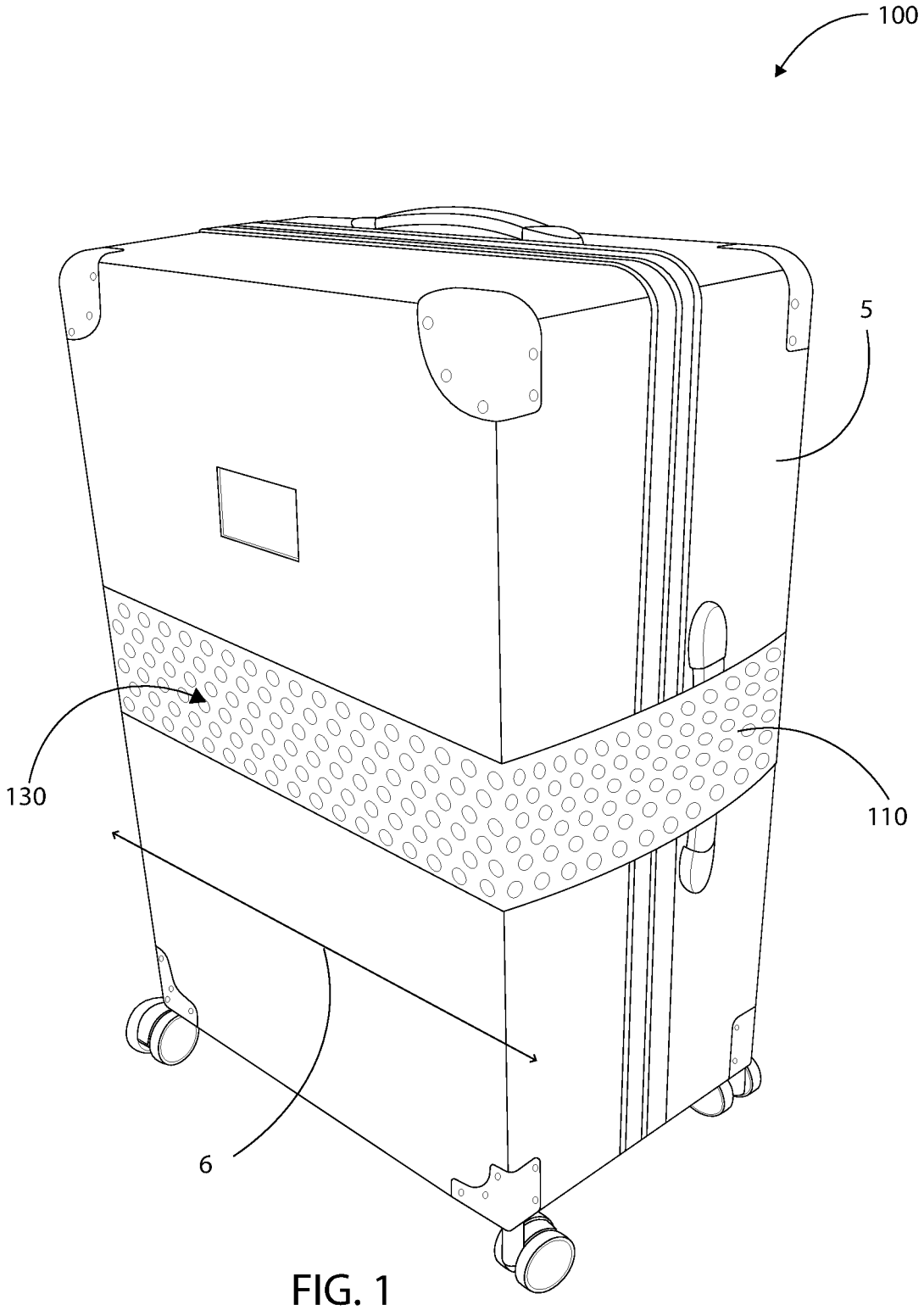
FIG. 1 is a front perspective view of a compressible sleeve positioned on a piece of luggage, according to an embodiment of the disclosure.
Figure 2:
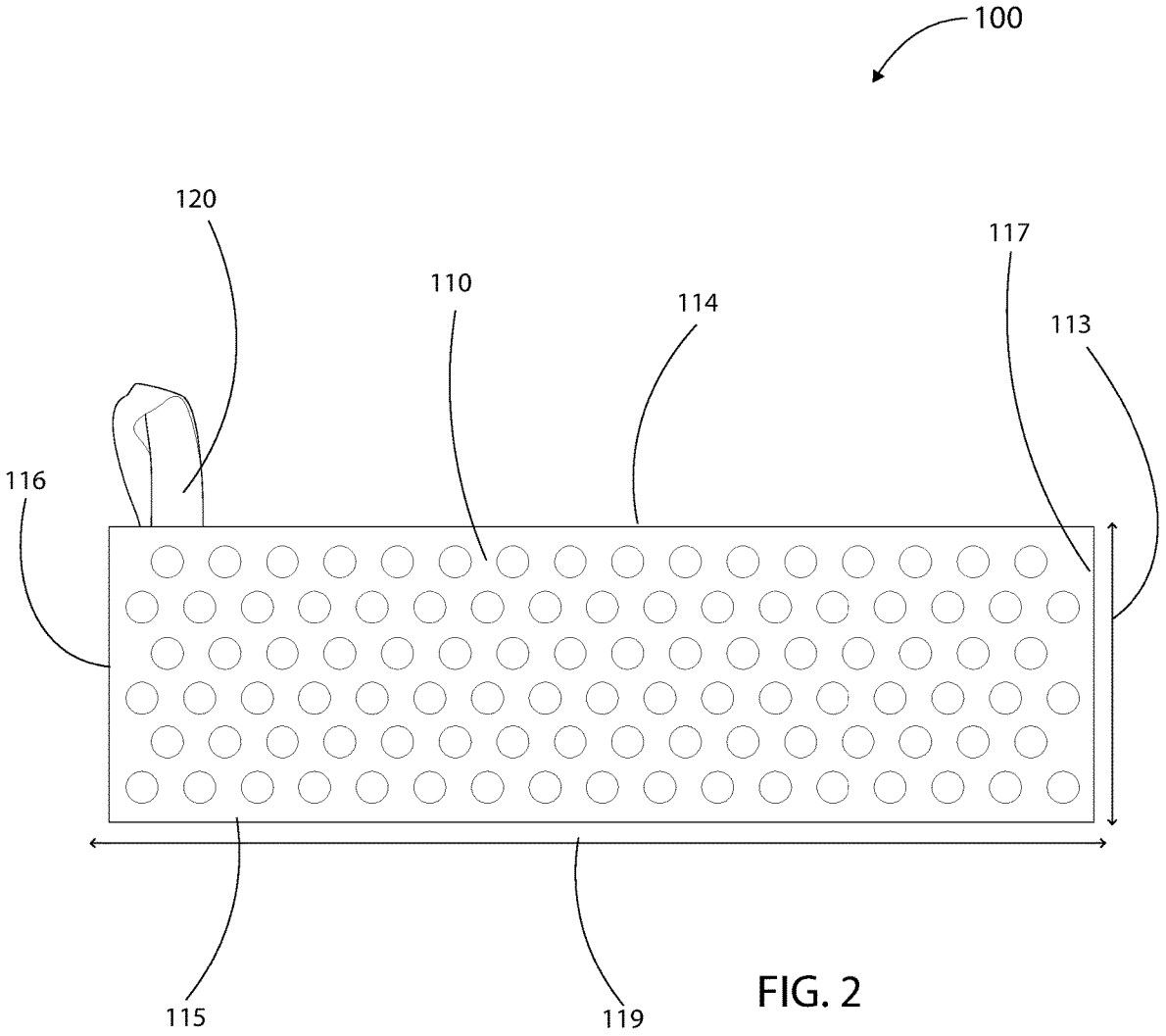
FIG. 2 is a front view of the compressible sleeve including a band and a fastener element, according to an embodiment of the present disclosure.
Figure 3:
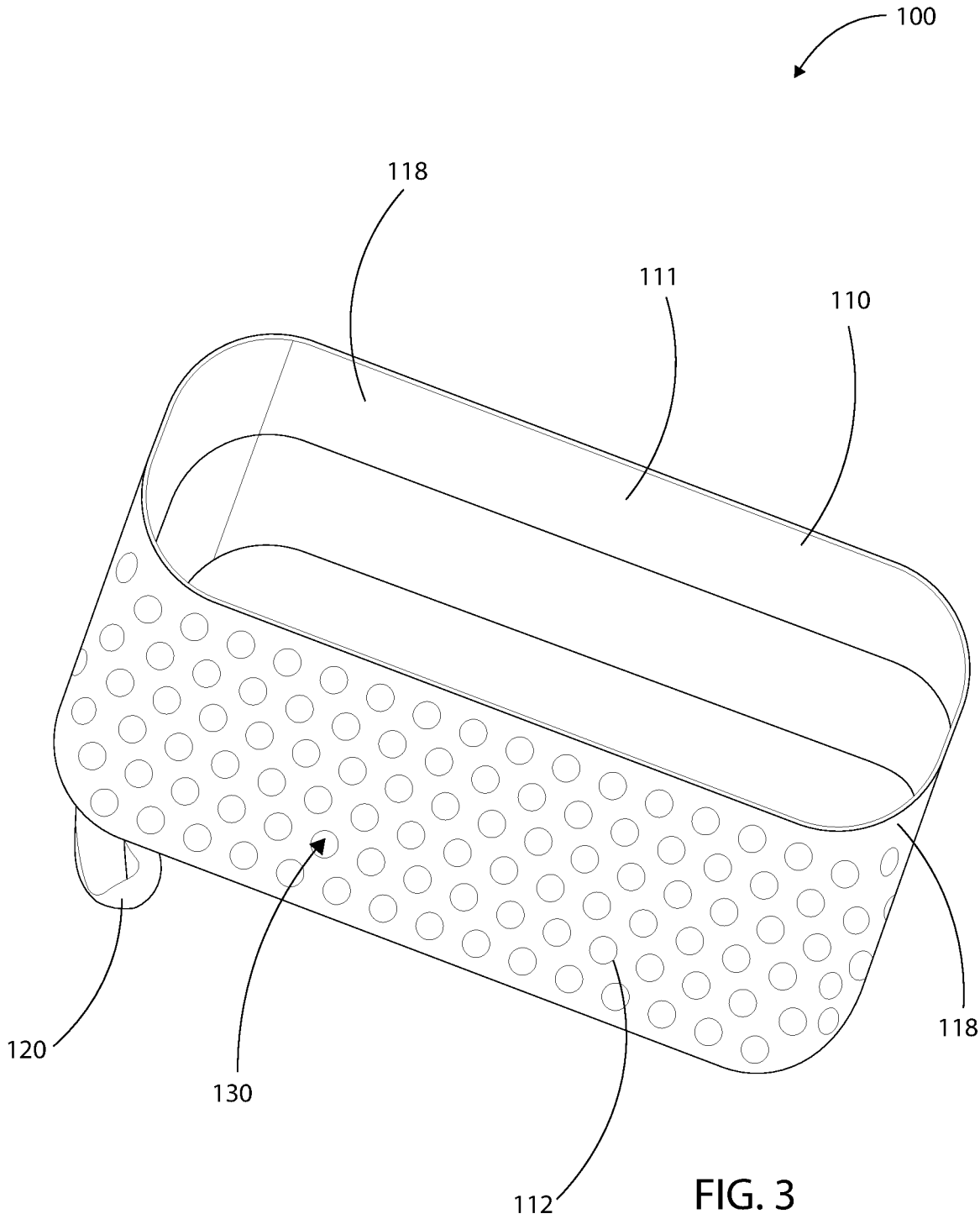
FIG. 3 is a top perspective view of the band having a functional decoration on a surface thereof, according to an embodiment of the present disclosure.

Referring more specifically to FIGS. 1-3, there is shown the band 110 according to embodiments of the present disclosure. As shown in FIG. 1, the band 110 may be configured to fit around the piece of luggage 5; particularly, the band 110 may be compressively fit around the piece of luggage 5, and as such, the band 110 may be constructed from an elasticated material. For example, the band 110 may be constructed from (but is not limited to being) spandex, or elastane material. As such, the band 110 is able to be stretched to fit over the piece of luggage 5 and the elastic properties of the band 110 may enable it to contract around the piece of luggage 5.

As shown in FIG. 2, the band 110 may include a length 119 of between 12-16 inches, as measured from a first side 116 thereof to a second side 117 thereof; and a width 113 of 5 inches, as measured from a top edge 114 thereof to a bottom edge 115 thereof. As shown in FIG. 1, the band 110 may preferably be positioned around a width 6 of the piece of luggage 5. To achieve the contraction, or compressive fit of the band 110 around the piece of luggage 5, the length 119 (FIG. 2) of the band 110 may be slightly smaller than the width 113 of the piece of luggage 5. For example, in some embodiments, for fitting around larger pieces of luggage, the band 110 may include a length 119 of 16 inches; for fitting around medium-sized pieces of luggage, the band 110 may include a length 119 of 14 inches; and for fitting around smaller-sized pieces of luggage, the band 110 may include a length of 12 inches. It should be appreciated however that these measurements are given as examples only and are not meant to limit the band 110 to any particular size.

As shown in FIG. 3, the band 110 may formed as a continuous loop and may include an inner surface 111 opposite an outer surface 112. In some embodiments, the band 110 may be constructed from two pieces 118 of (elasticated) material that are sewn together to form the continuous loop.

Figure 5:
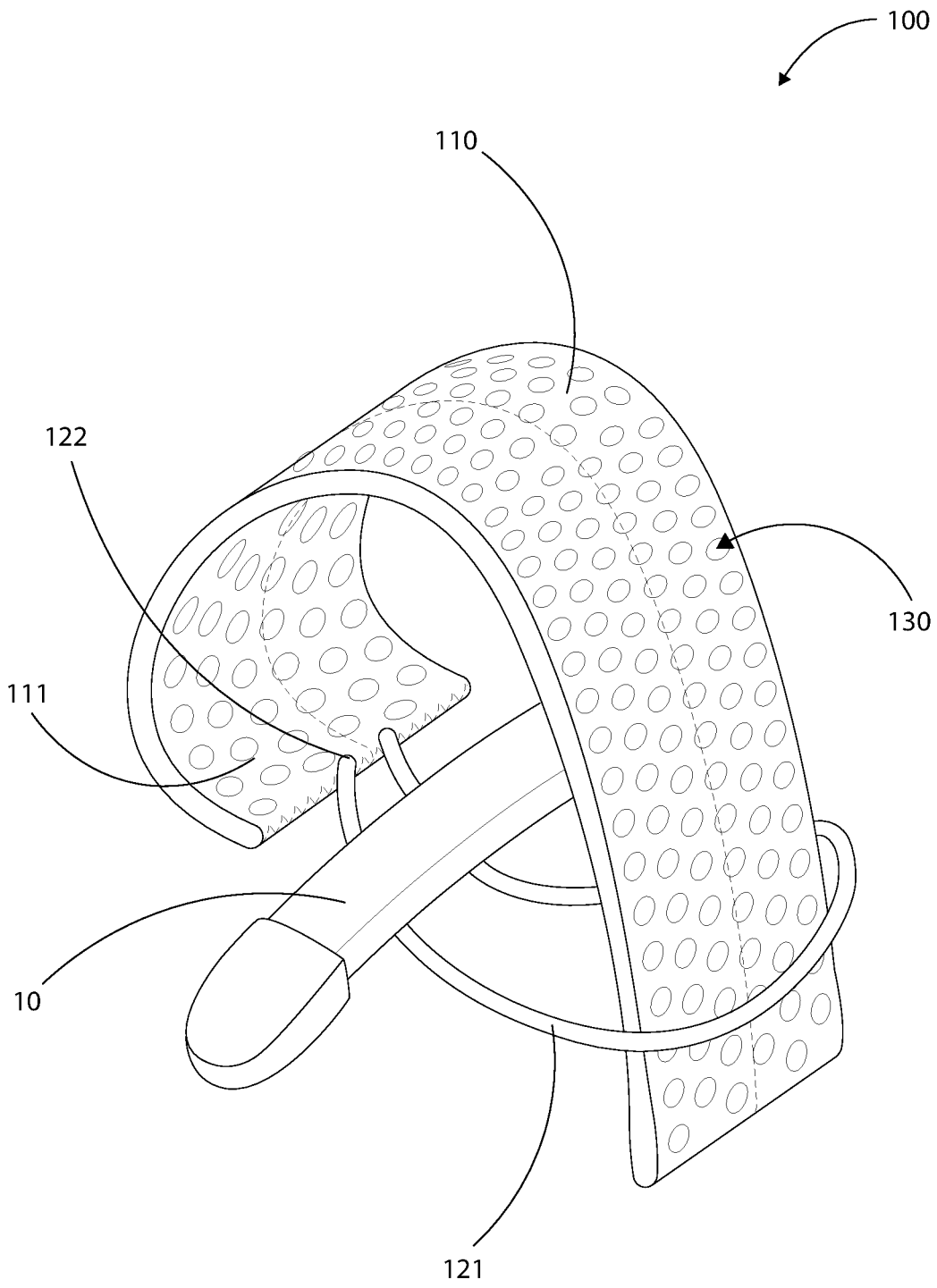
FIG. 5 is a close-up view of the fastener element being threaded under the handle and the band being threaded through a loop of the fastener element, according to an embodiment of the present disclosure.

As above, the compressible sleeve 100 may include at least one luggage-identifier for readily identifying the piece of luggage 5. As shown in FIGS. 1-3 in particular, at least the outer surface 112 of the band 110 may include a functional decoration 130. In some embodiments, the band 110 may be reversible, and thus, the inner surface 111 of the band 110 may also include the functional decoration 130 (as shown in FIG. 5). In some embodiments, the functional decoration 130 on the inner surface 111 and the outer surface 112 may be the same (matching); in other embodiments, the functional decoration 130 on the inner surface 111 and the outer surface 112 may be dissimilar (non-matching).

In some examples, as shown in FIGS. 1-3, the functional decoration 130 may include (but is not limited to) polka dots. Other functional decorations contemplated may include colors, logos, messages, and other patterns-any decoration that is readily identifiable by a user. As shown in FIGS. 1-3, the band 110 may be generally planar and may thereby lay flat against the piece of luggage 5 when installed thereon (FIG. 1), such that the functional decoration 130 is easily seen.

Figure 4:
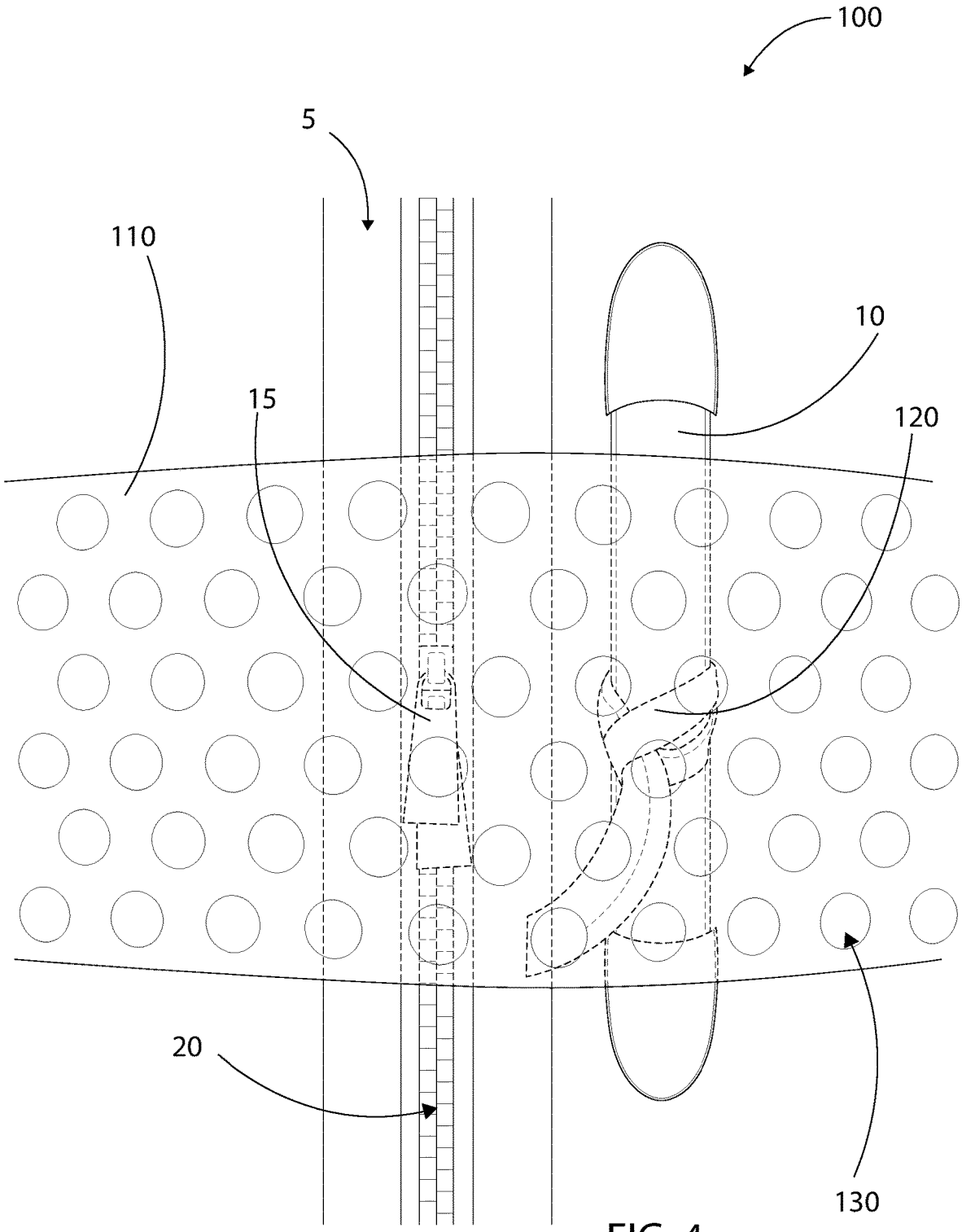
FIG. 4 is a close-up view of the band attached over pull tabs of a zip fastener of the piece of luggage and the fastener element attached to a handle of the piece of luggage, according to an embodiment of the present disclosure.

Referring now more specifically to FIGS. 4-5, there is shown the band 110 and the fastener element 120 in relation to each other and the piece of luggage 5 when attached. As shown in FIG. 4, the band 110 may be configured to be installed on the piece of luggage 5 such that the pull tabs 15 of at least one zip fastener 20 on the piece of luggage 5 (that enable the opening and closure of the piece of luggage 5) are held under tension of the band 110, when the band 110 is contracted around or compressively fitted around the piece of luggage 5. Thereby, movement of the pull tabs 15 may be at least substantially prevented and as such, inadvertent opening of the piece of luggage 5 may also be at least substantially prevented.

As shown in FIGS. 4-5, the fastener element 120 may be attached to the inner surface 111 of the band 110 and configured to fasten to a handle 10 of the luggage and aid in securement of the compressible sleeve 100 to the piece of luggage 5. As shown, the fastener element 120 may include a strap 121 formed into a loop. The strap 121 may be constructed from a fabric material and, as shown specifically in FIG. 5, free ends 122 of the strap 121 may be sewn to the inner surface 111 of the band 110 to form the loop. The pull tabs 15 and the fastener element 120 are shown in broken lines in FIG. 4 to show these elements underneath the band 110.

As shown in FIGS. 4-5, the strap 121 may be configured to thread through at least one handle 10 of the piece of luggage 5. Particularly, the strap 121 may be thread under a side handle 10 of the piece of luggage 5 and the band 110 may then be thread through the loop of the strap 121, causing the strap 121 to loop around the handle 10. In some embodiments, the fabric material of the strap 121 and/or band 110 may at least partially cushion a hand of a user when holding the handle 10.

Figure 6:
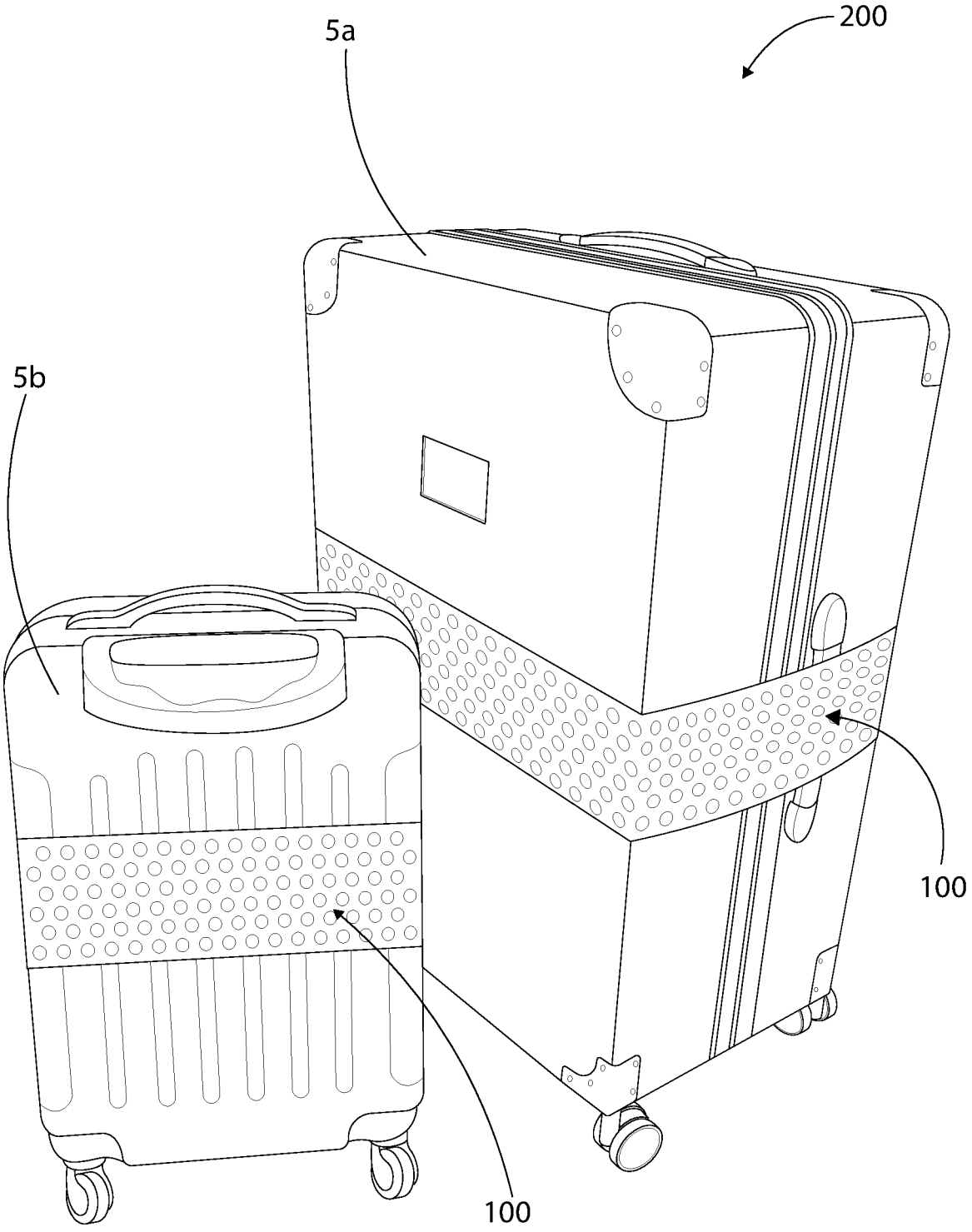
FIG. 6 is a perspective of view of a kit for unifying mismatched pieces of luggage, according to an embodiment of the present disclosure.

Referring specifically to FIG. 6, there is shown a kit 200 for use in unifying a plurality of mismatched pieces of luggage (5*a*, 5*b*). As shown, the kit 200 may include a plurality of compressible sleeves 100 each including the band 110 and the fastener element 120 as discussed above and shown in FIGS. 1-5. In this embodiment, at least the outer surface 112 of each of the plurality of compressible sleeves 100 may include the same functional decoration 130. For example, as shown in this figure, both compressible sleeves 100 include the same polka dot pattern. As such, the user is able to easily and readily identify both pieces of luggage (5*a*, 5*b*), despite the fact that the pieces of luggage (5*a*, 5*b*) are mismatched (not part of a set). Further, as shown in this figure and as discussed above, the kit 200 may include varying sizes of compressible sleeves 100 (for example, small, medium and/or large) to fit varying sizes of luggage 5.

In use of the compressible sleeve 100, the user may thread the strap 121 of the compressible sleeve 100 under and through the side handle 10 of the piece of luggage 5. The user may then thread the band 110 through the loop of the strap 121 and pull the band 110 through so that the strap 121 'loops' around the handle 10 of the piece of luggage 5 and thereby attaches the compressible sleeve 110 to the piece of luggage 5. The user may then stretch the continuous loop of the band 110 over a top side of the piece of luggage 5, with the functional decoration 130 facing outward, and position the band 110 such that the pull tabs 15 of the at least one zip fastener 20 on the piece of luggage 5 are held under tension of the band 110.

It should be noted that certain steps are optional and may not be implemented in all cases. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using the compressible sleeve are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A method of identifying luggage comprising:

providing a piece of luggage having at least one luggage handle;

providing an identification sleeve for use with the piece of luggage, the luggage identification sleeve including:

a band formed as a first continuous loop about a first loop axis, and constructed from an elasticated material such that the band is sized and dimensioned to be compressively fittable around the piece of luggage, the band having a band width of 5 inches as measured parallel to the first loop axis and perpendicular to a first circumference of the first continuous loop, an inner surface, an outer surface opposite said inner surface, and at least one decorative luggage-identifier on the outer surface; and a fastener element formed as a second continuous loop about a second loop axis, said fastener element fixed to the inner surface of the band, the fastener element having a fastener element length measured along the second continuous loop about the second loop axis, and a faster element width measured parallel with the second loop axis and perpendicular to a second circumference of the second continuous loop, said fastener element length being less than double the band width, said fastener element width being less than the band width, the fastener element configured to engage with and fasten around the at least one luggage handle of the piece of luggage as a girth hitch, said girth hitch made by first passing a bight of the girth hitch under and about the at least one luggage handle, then passing the entire band between the at least one luggage handle and the bight of the girth hitch, then tightening the girth hitch, the fastener element further configured to be both inscribed within the band and hidden from view by the band when fastened to the at least one luggage handle, attaching the fastener element to the luggage handle as a girth hitch; and stretch the band around the piece of luggage such that it is compressively fit in place.

* * * * *